United States Patent [19]

Gerich

[11] Patent Number: 4,750,941

[45] Date of Patent: Jun. 14, 1988

[54] LIQUID METERING, MIXING, DISPENSING, TESTING AND PURGING METHOD AND APPARATUS

[76] Inventor: Horst Gerich, 24034 Welby Way, Canoga Park, Calif. 91307

[21] Appl. No.: 818,676

[22] Filed: Jan. 14, 1986

[51] Int. Cl.[4] ..... B01F 5/05

[52] U.S. Cl. ..... 134/22.12; 134/22.11; 73/863.41; 73/863.61; 417/318; 417/404; 427/133

[58] Field of Search ..... 422/133; 417/349, 318, 417/393, 404, 323; 73/863, 195, 863.41, 863.61; 134/22.1, 22.11, 22.12, 22.14

[56] References Cited

U.S. PATENT DOCUMENTS 4,304,529 12/1981 Gerich ..... 417/349

4,548,652 10/1985 Kelly et al. ..... 422/133

*Primary Examiner*—Barry S. Richman

*Assistant Examiner*—William R. Johnsa

[57] ABSTRACT

An apparatus for metering, mixing, dispensing, testing and purging liquid compositions composed of predetermined ratios of reactive liquid components. Pressurized sources of the component liquids are coupled to valve mechanisms and liquid metering devices. The materials are metered in predetermined ratio to each other and fed to a mixer to be intimately combined and dispensed at a demand station for the intended use. A valve mechanism is provided immediately following the pressurized source of one of the liquids and upon operation of the valve this liquid is diverted around the valve and metering device and is fed directly into the first area in which the two liquids are co-mingled, thereby purging the entire area in which the co-mingled liquids exist. Upon operation of the purging valve, the entire operation of the valves and metering devices are stopped thereby significantly reducing the wear and tear on this portion of this apparatus. Also tubes are provided following the metering devices whereby samples from each liquid metering device may be simultaneously withdrawn and weighed to determine whether the metering devices are operating accurately in providing a predetermined ratio of the components in the final mixture.

13 Claims, 1 Drawing Sheet

LIQUID METERING, MIXING, DISPENSING, TESTING AND PURGING METHOD AND APPARATUS

This invention generally relates to a metering, mixing, dispensing, testing and purging liquid system for two or more inter-reactive liquids in predetermined ratios. Apparatuses for metering liquids of high viscosity are very expensive due to the material of construction and tolerances necessary to prevent leakage. This apparatus wears at an accelerated rate due to the close tolerances, thus it is desirable not to operate the metering apparatus during nonproductive times.

It is important to insure a very inexpensive purging operation by generally using the least expensive of the two liquids as a purging medium. The purging arrangement is such that a minimal amount of wear is effective on the metering portion of the equipment since the metering equipment discontinues operation and the purging operation bypasses the metering apparatus.

In addition, sampling tubes are provided whereby samples of the metered material may be obtained from the machine during operation and such samples are weighed to insure that the apparatus has attained and maintained a proper ratio between the components.

PRIOR ART

The present invention is an improvement on the apparatus and method shown in the U.S. Pat. No. 4,304,529. The apparatus shown in this patent has been commercially exploited and it was noted during this commercial usage that in order to purge the equipment it was necessary to provide elaborate valve mechanisms to insure a proper purge and to waste a considerable amount of valuable liquid material in the purging operation. It was found that this could be avoided by bypassing the metering devices on the machine and re-introduce the purging material into the system at the point where the two reactive materials are co-mingled since it is only necessary to purge the portion of the apparatus utilized by the co-mingled liquids. Thus, the material used for purging is the least costly of the two liquids and the entire operation of the metering devices is stopped during purging. By bypassing the expensive and complicated seals used on the metering devices, substantial increased operating life of the devices was achieved.

Also, during the operation of the machine it was found that users desired to periodically check the ratio of the two liquids being used. The present invention permits accurate sampling while the machine continues in operation, thus insuring maximum production but also insuring that the samples taken are the proper ratios being used by the machine in actual production.

OBJECTS OF THE INVENTION

Prior to the development of the apparatus shown in the U.S. Pat. No. 4,304,529, it was not possible to operate mixing machines similar to the patented machine at high pressures since the valves and metering devices had rather wide tolerances and thus the use of high pressures would result in extensive leaks in the apparatus and the ratio of the components would become inexact. It is important that dispensing and metering apparatus such as described in the aforesaid patent be capable of operating at high pressures since some of the materials to be processed in this apparatus are very viscose and thus require pressures which are very high in order to move the viscose material and particularly to mix it in a proper way. As the viscosity of the material being treated increases the difficulty in properly mixing material also increases tremendously.

The mixing devices used in mixing liquids according to the present invention are static mixing devices such as shown in U.S. Pat. No. 3,638,678. These mixing devices are relatively expensive and thus it is important to have a proper purge of the mixing devices with the metering and dispensing apparatus is shut down for any period of time. If the machine is not purged during any time period longer than the reaction time of the materials being processed, the materials will react and "set up" into a finished material within the machine, thus necessitating dismantling the machine and putting in new parts-all of which is a time consuming and expensive proposition. Normally the materials being processed in this equipment have a very fast cure rate.

DESCRIPTION OF PRESENTLY PREFERRED EMBODIMENT

Figure 1:
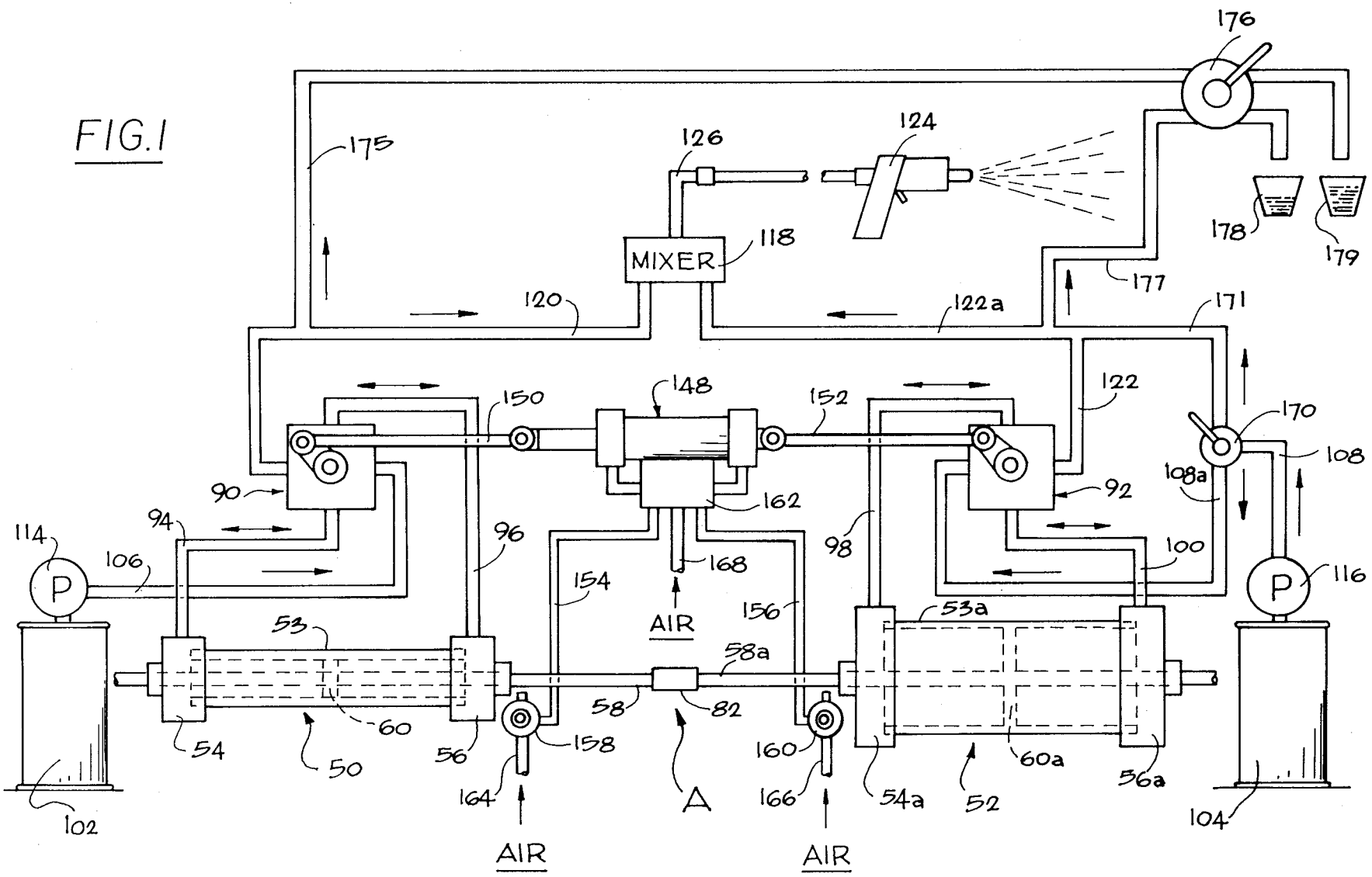
FIG. 1 is a schematic side elevational view of a fluid metering and dispensing machine constructed in accordance with and embodying the present invention.

Referring now in more detail and by reference characters to the drawings which illustrate a practical embodiment of my invention, all of the description contained in prior U.S. Pat. No. 4,304,529 is incorporated herein by reference and parts of it will be briefly described hereinafter for completeness of the present disclosure.

Also for completeness in this application, the subject matter of U.S. Pat. No. 4,549,676 entitled "Liquid Mixing and Purging Apparatus" is incorporated herein by reference. This patent illustrates various technical valve arrangements in the manifolds which are useful in the present invention but do not form a part of the present invention.

The apparatus A, a liquid metering and delivery system including the present invention, is more fully illustrated in FIG. 1 of the drawings. The apparatus A comprise a first pumping means 50, a second pumping means 52 and both of which are in the form of piston cylinder type pump arrangements. The pumping means 50 and 52 are often referred to a "pumping units" or "pumps" and each are similar in construction and operation. The pumping units are really metering units in as much as they effectively meter the fluids. Moreover the pumping units do not include a drive mechanism in the same manner as commercially available pumps, due to the fact they are driven by other fluid driving members, such as other remote pumps.

The first pumping means 50 is designed to pump a first fluid, such as a catalyst, and the second pumping means 52 is designed to pump a second fluid such as a catalyst base liquid. Therefore the construction and operation of the first pumping unit 50 will be described in some detail and the pumping unit 52 is substantially similar in construction. The same reference numerals are provided for common parts in the second pumping unit as are used on the first pumping unit except that on the second pumping unit the parts are identified with a small letter "a".

The first pumping unit means is comprised of a pumping cylinder 53 which is cylindrically shaped and elongate and has endcaps 54 and 56 at the opposite traverse ends thereof. A piston rod 58 having a suitable piston 60 carried therewith is axially shiftable within the cylinder 53.

The piston 60 is of somewhat conventional construction in the form of relatively flat plate and may be provided with an annularly extending cup seal engageable with the inner face cylinder 53. The piston rod 58 is reciprocal in and is sealed by resilient sealing rings and packing around the rod at the point it goes through the end caps 54 and 56. These seals and structure are described in more detail in prior U.S. Pat. No. 4,304,529.

The pumping units 50 and 52 are constructed to operate in a coordinated manner together in as much as piston rod 58 and 58a are connected together through a shaft coupling 82, the latter of which is a conventional shaft coupling for securement of each of the opposed ends of the two piston rods. Thus, when liquid is introduced in the left-hand side of the cylinder 53 through an inlet pipe 94, liquid will be discharged or pumped out through the right-hand end of end cap 56 through a pipe 96. This will occur when the piston 60 and hence the piston rod 58 are shifting to the right as viewed in FIG. 1. In like manner, liquid will simultaneously enter the cylinder 53a of the pumping unit 52 through the left-hand cap 54a via pipe 98 and will discharge through the right-hand end of unit 52 through the end cap 56a via pipe 100. This occurs as the piston 60a of the pumping unit 52 is shifting to the right.

The pumping units 50 and 52 effectively meter the two liquids in accordance with the diameter size of the cylinders of the pumping units. According to the drawing, it is noted that the cylinder 53 of pumping unit 50 has a diameter size which is substantially smaller than the cylinder of 53a of the pumping unit 52. In as much as the movement of the piston rods 58 and 58a in a linear direction is the same regardless the direction of travel the amount of liquid effectively pumped out of cylinders 53 and 53a is a function of the overall size of the cylinders, and particularly of the overall diametrical size of the respective cylinders 53 and 53a. If one desires to change the ratio of the two liquids, it is merely necessary to change the diameter of the cylinder and its associated piston to accomplish the ratio desired. The cylinders 53 and 53a and their associated pistons 60 and 60a may be easily removed and replaced to change the liquid ratios.

The pumping unit 50 has liquid carrying lines 94 and 96 connected to a valve means 90 and the pumping unit 52 as liquid carrying lines 98 and 100 connected to a separate valve means 92. These valve means are four-way valves to be more fully explained hereinafter.

Each of the valves 90 and 92 are individually connected to separate sources of pressurized liquid such as liquid 102 and 104. In this case the liquid containers can be drums such as 55 gallon drums of the type normally used to haul and store such liquids. Special containers can be provided if desired particularly when it is desired to keep the liquid free from air which may cause them to deteriorate or to avoid air bubbles which would provide flaws in the product being produced. Typically one of the liquids is a base liquid and the other liquid is a catalyst. For purposes of illustrating and describing the invention it will be assumed that the liquid in container 102 is a catalyst and the liquid in container 104 is a base liquid. Normally the base liquid is substantially less in cost than the catalyst.

The materials used in the construction of the valve units and the associated pumping units as well as the various liquid delivery pipes should be selected to be compatible with the liquids being pumped and metered.

In many applications of the present invention it is necessary to pump liquids having high viscosity. In order to pump these high viscosity liquids it is necessary to have very high pressures within the system, sometimes approaching 2000 to 3000 pounds per square inch. At these pressures the seals on the valves and pumping units are subjected to great stress and their useful life diminished. Of course, highly viscous liquids can be pumped at lower pressures but the volume of the liquid which is moved is very small, and it is not useful from a practical production standpoint.

Each of the containers 102 and 104 are respectively connected to the individual valves 90 and 92 through liquid delivery pipes 106 and 108–108a respectively. Individual pumping means as for example liquid pumps 114 and 116, are connected directly to liquid containers 102 and 104 respectively. Other pumping arrangements can be used. In addition individual pumps (not shown) could be connected to the liquid delivery lines 106 and 108. In this way when the pumps associated with each of the containers 102 and 104 have been energized the liquids in these containers will be delivered to the two valves 90 and 92. In accordance with the positions of the valves the liquids would then be introduced into each of the individual pumping units 50 and 52.

Each of the valves 90 and 92 are also connected to separate mixing means such as conventional mixing unit 118 through valve discharge pipes 120 and 122–122a in the manner illustrated in the drawings. The mixing unit 118 may be a mixing gun or otherwise, or it can be connected to conventional mixing gun 124 through a connecting pipe 126.

Each of the valves 90 and 92 are preferably at the same position during the operation of the apparatus A of the invention. Here again the construction and operation of valve 92 is substantially similar to that of valve 90 and accordingly only the operation of valve 90 will be described here in more detail.

When the valve 90 is in a first position as illustrated in the figure, the lines 106 and 94 are connected to each other through the valve mechanism of valve 90, and the lines 96 and 120 are connected to each other through the valve mechanism of valve 90. Thus as the pump 114 pumps liquid from container 102 through line 106, through valve 90 and into line 94, the liquid enters pumping unit 53 from the left-hand end through the end cap 54 and moves the piston 60 toward the right. As the piston 60 moves to the right it forces the catalyst liquid material out the right end of cylinder 53 through the end cap 56, through pipe 96 and through the valve 90 into pipe 120, thereby feeding catalyst material to the mixer 118. In a similar operation the base material from container 104 is fed to the mixer 118.

When the rod 150 is moved to the right in a manner to be described hereinafter, the valve 90 is rotated 90 degrees thereby bringing line 94 into communication with line 120 and line 96 in the communication with line 106. With the valve in this position the material is pumped from container 102 by the pump 114, through line 106 and the valve 90, into line 96 and thereby into the right end of pumping unit 50 thereby moving the piston 60 toward the left together with its associated piston rod 58. Simultaneously the piston 60 forces the catalyst liquid out of the pumping unit 50 through line 94 and valve 90, into line 120 and ultimately to the mixer 118. The pumping unit 52 operates in a similar manner to unit 50.

The apparatus of the invention utilizes actuating means, preferably in the form of a pnuematic actuator 148. The actuator 148 serves to actuate the valves 90 and 92 to the right or left positions, which in turn actuate pumping units 50 and 52. The actuator 148 is operatively coupled to actuator rods 150 and 152. The rod 150 is pivotally connected to the valve 90 and the rod 152 is pivotally connected to valve 92.

The pnuematic actuator 148 is coupled to the various pumping units 50 and 52 through couplings which include fluid lines 154 and 156 and associated ball actuators or poppets 158 and 160 respectively.

The actuator 148 is provided with an air controller 162 which could be in the form of an electrically operated solenoid. The controller 162 is pressure responsive and is capable of responding to the ball actuators 158 and 160 being contacted by the shaft coupling 182. In this case each of the ball actuators 158 and 160 are provided with a supply of air or other gas under pressure through inlet air lines 164 and 166 respectively. Moreover the controller 162 is provided with an air inlet line 168 which is the main air supply for the actuator 168. The air controller 162 which is responsive to air pressure changes, functions as a solenoid in that when a change in air pressure is sensed in either of the lines 156 and 154, the controller will cause the actuator 148 to change the direction of operation. The ball actuators are conventional construction and when contacted by an object such as the shaft coupling 82 will cause a momentary bleeding of air from the line inlet lines 164 and 166. Thus there will be a momentary pressure drop in lines 154 or 156 which is sufficient to cause the air controller 162 to cause the actuator 148 to change its direction of operation, thereby shifting valves 90 and 92 through a 90 degree movement. One form of air controller and actuator combination is commercially available from Mosier Industries, Inc. of Brookville, Ohio and is referred to as their air actuator special model S-20423A. Other air actuators of this type are more fully described in U.S. Pat. No. 3,913,416.

Of course, the ball actuators 158 and 160 could be replaced by micro switches.

When the actuator 148 is activated to move in a right or left direction it causes the linkage rods 150 and 152 to shift in the same direction at the same time. This will move the valves 90 and 92 through a 90 degree arc to one of their two positions.

When the pistons 60 and **60*a* have reached the left-hand portion of cylinders 53 and 53*a*, respectively, the shaft coupling 82 engages the ball activator 158 thereby causing the air controller to respond to the resultant change in pressure as previously described. As that occurs, the air controller 162 will cause the actuator 148 to change direction and this will cause the valves to change from one to the other of their positions thereby permitting liquid flow into the left ends of each of cylinders 53 and 53*a*. This will in turn cause the piston rods 58 and 58*a* and pistons 60 and 60*a* to shift to the right. As this occurs the catalyst from the container 102 will be introduced to the left-hand side of the cylinder 53 and the liquid from the base container 104 will be introduced to the left-hand side of cylinder 53*a*. Moreover the catalyst will be pumped out of the right-hand side of cylinder 53 through the valve 90 and into the mixer 118. In like manner the base liquid will be pumped out of the right-hand side of the cylinder 53*a*, through the pipe 100 and the valve 92 into the mixer 118**.

This reciprocative process will continue such that there is continuous flow of the various liquid components to the mixer 118 in their proper ratio.

The valve 170 is a two position valve which directs liquid from pipe 108 to pipe **108*a* when in its first position, and from pipe 108 to pipe 171 when in its second position. The valve 170** is in its first position during operation of the machine as described above and in its second position during purging of the equipment.

During purging of the equipment, the valve 170 is moved to its second position so that the pressurized liquid (base material in the present example) flows from pipe 108, through valve 170, and through pipes 171 and **122*a* to mixer 118. When valve 170 is moved to its second position, no base liquid is flowing into or out of unit 52. Simultaneously the flow of catalyst liquid into and out of unit 50 ceases even though pump 114 has not ceased operation. The operation of unit 50 has ceased because there is not enough pressure produced by pump 114 to pump the catalyst liquid to and from unit 50 and also overcome the tremendous drag from the base unit 52 not being driven by pump 116**.

It is also possible to disconnect the electrical power source from pump 114 at the time that valve 170 is moved to its second position, but in the configuration shown in FIG. 1, this is unnecessary.

Thus the catalyst feed to mixer 118 has ceased, and only base material is being fed to and through the mixer 118, pipe 126 and out gun 124. As soon as the purge with base liquid is completed through mixer 118, pipe 126 and gun 124, the power to the entire equipment is stopped. This insures that the material will not cure inside the apparatus thus necessitating dismantling and cleaning the apparatus.

Normally the apparatus would be purged by discontinuing the power to pump 114 to stop feeding the catalyst liquid, and the base liquid would continue so as to purge the equipment. This is not an effective purge and frequently results in partial curing in the apparatus. Or, another common way to purge the apparatus was to continue the operation of the entire apparatus but remove the catalyst through a valve in pipe 120 to a waste dump. This would result in purging the machine with the base liquid. This method results in a large waste of the catalyst liquid which is normally much more expensive than the base liquid. Some systems have attempted to recycle the catalyst liquid during base purging. This is difficult or impossible to accomplish as the catalyst is sensitive to air and the equipment is being run with air excluded.

The present invention accomplishes the base purge without the continued operation of the expensive components, i.e., units 50, 52 and valves 90 and 92; which are built of expensive materials and with close tolerances so that the equipment can be run at high pressures.

Pipe 175 provided a source of catalyst liquid to valve 176. Pipe 177 provides a source of base liquid to valve 176. Pipe 175 and 177 are under normal catalyst liquid and base liquid pressures, respectively. When valve 176 is moved from closed position to open position, it delivers two streams of liquid-one stream of catalyst liquid and one stream of base liquid. The streams are delivered to individual collection containers 178 for base liquid and 179 for catalyst liquid. The liquids will be delivered to the containers in exactly the amount being supplied to mixer 118.

Thus, the person sampling the liquids, to insure proper ratio of the components does not have to time the samples, etc. but merely collects them and weighs them. This will determine whether the volumetric ratios are correct. The machine operation was originally set up on volumetric ratios at the metering units 50 and 52.

While I have described a present preferred embodiment of my invention, it may be otherwise embodied within the scope of the following claims.

I claim:

1. An apparatus for pumping and metering a plurality of combinable liquids which are reactable together to form a compound, said apparatus comprising:

(a) a plurality of first valve mechanisms with a single valve controlling the flow of one of the liquids;

(b) a piston and cylinder metering and pumping unit for each liquid, wherein each of the metering and pumping units is operatively connected to one of said valve mechanisms; and said valve mechanisms and said metering and pumping units being fabricated with close tolerances to permit operation thereof at elevated pressures;

(c) an actuating and coupling means operatively connected to each of said valve means;

(d) a pressurized source for each of said liquids which delivers the pressurized liquid to the valve mechanisms and metering and pumping units;

(e) a manifold to which the plurality of liquids are delivered from the valve mechanisms and pumping units; and in which the plurality of liquids are mixed;

(f) a bypass pipe which operatively connects the pressure sourse and the manifold and which bypasses the first valve and the respective metering unit;

(g) a second valve in said bypass pipe whereby upon opening the valve one of the liquids bypasses the first valve causing the other liquids to cease flowing to the valve mechanisms and pumping units;

(h) said pipe delivering said one liquid to said manifold while all other liquids cease being delivered to the manifold, whereby the manifold is purged of all liquids except said one liquid.

2. An apparatus according to claim 1 wherein said metering and pumping units deliver a different volumetric flow for each of said liquids, and, further comprising (a) a first pipe operable to receive liquid flow from one of said metering and pumping units; and a discharge end of said first pipe;

(b) a second pipe operable to receive liquid flow from a second of said metering and pumping units, and a discharge end of said second pipe;

(c) a valve operable in each of said first and second pipes; said valve operable to simultaneously start and stop the liquid flow in the pipes; whereby samples may be simultaneously and individually collected from the discharge end of said pipes to test for correct volumetric flow from said pipe.

3. An apparatus according to claim 1 wherein said valve mechanisms and said metering and pumping units are operated at pressures greater than 1500 psi.

4. An apparatus according to claim 3 wherein said pressures exceed 3000 psi.

5. In an apparatus for feeding, proportioning, mixing and purging first and second combinable and cooperable liquids which are reactable in order to form a compound resulting therefrom, said liquids being maintained separate from each other until they are mixed together at a mixer prior to use, the proportions of the liquids relative to each other in the mixed compound being constant and predetermined; said apparatus comprising:

(a) a first four way valve having a valve housing and a valve mechanism located therein to control a first liquid flow in either a first and second liquid flow positions, (b) a second four way valve having a valve housing and a second valve mechanism located therein to control a second liquid flow in either of first or second liquid flow positions, (c) a first pumping unit operatively connected to said first valve, said first pumping unit being connected to said first valve only by liquid delivery tubes, said first valve being adapted to provide for delivery of the first liquid to said first pumping unit in either of said first or second liquid flow positions and being adapted to receive the first liquid from said first pumping unit in either of said first or second liquid flow positions, said first valve also being adapted to provide for delivery of the first liquid through the first valve to a demand station, said first valve also being arranged so that liquid flow to the demand station may occur simultaneously with liquid flow to the first pumping unit in both of the first and second liquid flow positions, (d) a second pumping unit operatively connected to said second valve, said second pumping unit being connected to said second valve, only by liquid delivery tubes, said second valve being adapted to provide for delivery of the second liquid to said second pumping unit in either of said first or second liquid flow positions and being adapted to receive the second liquid from the second pumping unit in either of the first or second liquid flow positions, said second valve also being adapted to provide for delivery of the second liquid through the second valve to said demand station, said second valve also being arranged so that liquid flow to the demand station may occur simultaneously with liquid flow to the second pumping unit in both of said first and second liquid flow positions, (e) an actuating unit operatively connected to each of said first and second valves, said actuating unit being connected to said first and second valves only by respective first and second actuating arms, said first and second actuating arms being actuated simultaneously by said actuating means such that said first valve is shifted to the first flow position by said first actuating arm simultaneously with the second valve being shifted to the first flow position by the second actuating arm, and that said first valve is shifted to the second flow position by said first actuating arm simultaneously with the second valve being shifted to the second flow position by the second actuating arm, and (f) first and second coupling elements located to be actuated by said first and second pumping units and said actuating units also being operatively connected to said first and second pumping units only by said first and second coupling elements; the improvement comprising a third valve means to terminate the flow of said first and second liquids in all of the above described apparatus, said third valve means diverting the flow of the first liquids past the first valve to a position where said first and second liquids are first combined in a combined liquid flow, where said third valve allows the flow of only said first liquid from said upstream position to the normal delivery point of the mixed first and second liquids because the flow of first liquid bypasses the first pumping unit.

6. In an apparatus according to claim 5 wherein the improvement further comprises a first liquid delivery tube to receive said first liquid after the first pumping unit and before the first and second liquids are mixed; a second liquid delivery tube to receive said second liquid after the second pumping unit and before the first and second liquids are mixed, valve means in said first and second tubes operable to simultaneously deliver liquids from said tubes in the same ratio in which the liquids are delivered to the demand station, thereby accurately testing the ratio of the two delivered liquids.

7. In an apparatus according to claim 5 further comprising that said first and second pumping units are capable of operating at pressures in excess of 1500 psi.

8. An apparatus according to claim 5 further comprising in that said first and second pumping units are each dual acting piston-cylinders devices which are capable of pumping fluids in each direction at pressures in excess of 1500 psi.

9. In a method of purging mixed liquid from a system for mixing the liquids which react with each other to form a compound, said liquids being maintained separate from each other until they are mixed together at a mixer prior to use, the individual liquids being fed to a metering device to properly proportion each liquid relative to any other liquid so that the proportions of the final reactant liquids remain constant during metering and mixing the liquids; and the properly proportioned liquids are then fed to a mixer device where they are mixed together and subsequently delivered to and discharged at a use site for the mixed liquids; wherein the improvement comprises the steps of:

(a) diverting the flow of one of the liquids around said metering device and directly to said mixer; wherein the diversion of said one liquid immediately results in a stopping of the flow of the other liquid to the metering and mixing devices;

(b) continuing the flow of said one liquid until all mixed liquids are purged from said mixer and through to the discharge at the use site.

10. In a method according to claim 9 wherein said one liquid is a resin material and said other liquid is a catalyst material, and such liquids being reactive with each other when mixed in critical proportions, thereby necessitating separation of the liquids from each other until mixed for use.

11. In a method according to claim 9 wherein said liquids must be maintained completely separate from each other until they are mixed together at said mixer prior to use, said method further including the steps:

(c) maintaining separate flow paths for each liquid up to said mixer during the diverting and purging steps.

12. A method of feeding, proportioning, mixing and purging reactable liquids comprising:

(a) establishing a flow of a first liquid to a metering device;

(b) establishing a flow of a second liquid to the metering device, (c) metering said flows at the metering device so that separate flows of the metered liquids are subsequently delivered in flows having constant fixed predetermined proportions between said first and second liquids, (d) delivering said liquid flows of proportioned liquids to a mixer and intimately mixing the flows therein, (e) diverting the flow of one of said liquids around the metering device thereby ceasing the metering of said one liquid, and simultaneously discontinuing the flow of the second liquid through the metering device to the mixer;

(f) delivering the diverted flow directly to the mixer;

(g) continuing the diverted flow through the mixer until the mixed liquids are substantially purged from the mixer; and, (h) subsequently discontinuing the diversion of one of said liquids and reestablishing the flow of said liquids to the metering device and metering said liquid flows to establish proportions between the liquids the same as previously proportioned.

13. A method according to claim 12 further comprising:

(i) diverting a portion of the flow of said first liquid after metering said flow, (j) diverting a portion of the flow of said second liquid after metering said flow, (k) said diversion of the first and second liquid portions being accomplished simultaneously;

(l) collecting separate simultaneous samples from the diverted flows; and, (m) establishing the quantity of each flow from said samples.

* * * * *